US005317346A

United States Patent [19]

Garcia

[11] Patent Number: 5,317,346

[45] Date of Patent: May 31, 1994

[54] COMPOUND INK FEED SLOT

[75] Inventor: Andre Garcia, Corvallis, Oreg.

[73] Assignee: Hewlett-Packard Company, Palo Alto, Calif.

[21] Appl. No.: 845,882

[22] Filed: Mar. 4, 1992

[51] Int. Cl.[5] ..... B41J 2/14

[52] U.S. Cl. ..... 346/140 R; 346/1.1

[58] Field of Search ..... 346/140 R, 1.1; 29/620; 156/644, 649, 653, 657, 659.1, 662

[56] References Cited

U.S. PATENT DOCUMENTS

| | | | |
|---|---|---|---|
| 4,535,343 | 8/1985 | Wright et al. | 346/140 R |
| 4,683,481 | 7/1987 | Johnson | 346/140 R |
| 4,719,477 | 1/1988 | Hess | 346/140 R |
| 4,862,197 | 8/1989 | Stoffel | 346/140 R |
| 4,882,595 | 11/1989 | Trueba et al. | 346/140 R |

*Primary Examiner*—Benjamin R. Fuller
*Assistant Examiner*—J. E. Barlow, Jr.

[57] ABSTRACT

A thin film thermal ink jet printhead having a compound ink feed slot that includes a trench in the top surface of a silicon substrate and a plurality of slots extending from the bottom surface of the silicon substrate to the trench. A plurality of patterned thin film layers are disposed on the top surface of the silicon substrate apart from the trench, and a patterned ink barrier layer is disposed over the plurality of patterned thin film layers. The patterned ink barrier layer includes an opening generally in alignment with the elongated trench, and a plurality of openings that form ink containing chambers which are adjacent to the trench and in communication with the opening that is generally in alignment with the elongated trench. Ink is conveyed from outside the substrate through the slots and trench, and into the ink containing chambers. The patterned thin film layers on the silicon substrate include a metallization layer and a passivation layer overlying the metallization layer, and the trench is advantageously formed by overetching of the passivation layer to remove it from the region in which the trench is to be formed.

4 Claims, 5 Drawing Sheets

COMPOUND INK FEED SLOT

BACKGROUND OF THE INVENTION

The subject invention generally relates to thermal ink jet printheads, and is directed more particularly to a thin film thermal ink jet printhead having a compound ink feed slot.

Thin film thermal ink jet printheads commonly comprise a substrate such as silicon on which are formed various layers that form thin film ink firing resistors, interconnections between the ink firing resistors and external contacts of the printhead, an ink barrier that is configured to define ink containing regions including ink containing chambers that are disposed over associated ink firing resistors, and a nozzle plate having nozzles attached to the ink barrier. The various layers of a thin film thermal ink jet printhead are typically formed by thin film photolithographic masking and etching techniques. The ink barrier may be formed using photolithography to pattern a suitable material. An electroformed metal nozzle plate is then laminated to the ink barrier layer.

A known arrangement for feeding ink into the ink containing chambers includes the use of a relatively large ink feed slot formed through the substrate whereby ink flows, for example pursuant to capillary action, from the lower side of the substrate to the ink chambers. An important consideration with the use of a large ink feed slot formed through the substrate is the reduction in strength of the substrate resulting from the formation of the large ink feed slot. Thus, mechanical fragility is a controlling factor in determining the size of the substrate, rather than the intended functionality, which results in greater cost due to the larger substrate. Moreover, manufacturing yield may decrease when substrate size is close to the minimum limit.

SUMMARY OF THE INVENTION

It would therefore be an advantage to provide a thin film thermal ink jet printhead having increased strength.

Another advantage would be to provide thin film ink jet printhead that can be made smaller without compromising strength.

The foregoing and other advantages are provided by the invention in a thin film thermal ink jet printhead that includes a substrate, an elongated shallow trench formed in the top surface of the substrate, a plurality of slots extending through the substrate to the elongated trench, and a plurality of patterned thin film layers disposed on areas of the substrate apart from the trench. A patterned ink barrier layer disposed over the plurality of patterned layers includes an opening generally in alignment with the elongated trench, and a plurality of openings that form ink containing chambers which are adjacent to the trench and in communication with the opening that is generally in alignment with the elongated trench. The slots and the trench form a compound ink feed slot by which ink is conveyed from outside the substrate through the slots and trench, and into the ink containing chambers.

The foregoing thermal ink jet printhead is advantageously made pursuant to a process that includes the following steps. Active device regions and a trench region in the top of a silicon substrate are defined, and an oxide layer is formed on the top surface of the substrate exclusive of the active device regions and the trench region. A patterned resistive layer and a patterned metallization layer are then formed over the field oxide layer. A passivation layer is formed over all exposed layers disposed on the substrate and exposed areas of the substrate. The passivation layer is then masked and etched to (a) form openings therein to the underlying metallization layer, (b) remove the passivation layer from the trench region, and (c) form a trench in the trench region. Alternatively, the passivation layer may be masked and etched two times: first to perform (a); then subsequently, after all thin films have been deposited and etched, to perform (b) and (c). The second alternative is desirable when reaction products of the trench silicon etch are incompatible with the standard passivation etch equipment used to form precision vias and when the trench interferes with the patterning of photoresist used to define the higher level thin film layers overlying the passivation layer.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
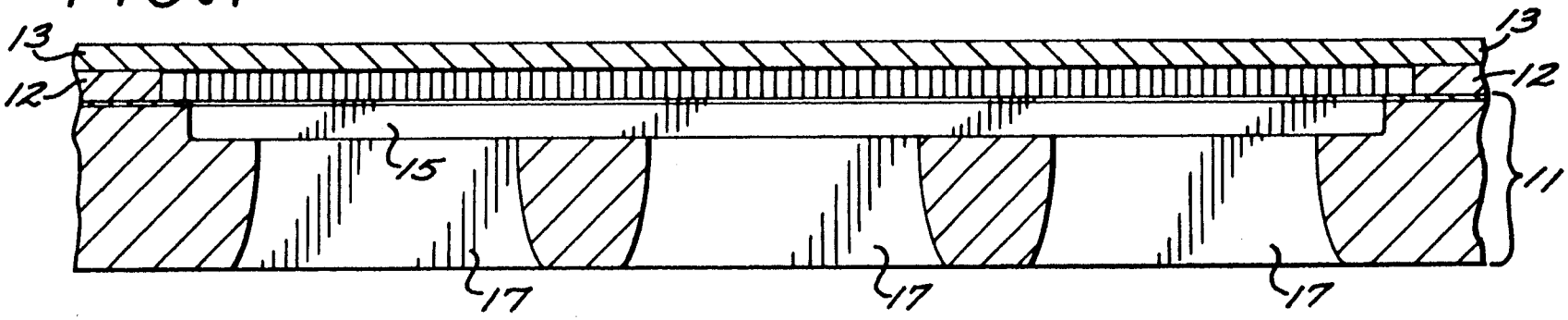
FIG. 1 is a sectional view of a thin film thermal ink jet printhead in accordance with the invention taken along the length of a shallow trench of a compound ink feed slot formed in the substrate of the printhead.

In the following detailed description and in the several figures of the drawing, like elements are identified with like reference numerals.

Referring now to FIG. 1, set forth therein is an unscaled schematic cross sectional view of a thin film thermal ink jet printhead that generally includes (a) a thin film substructure or die 11 comprising a substrate having various thin film layers formed thereon, (b) an ink barrier 12 layer disposed on the thin film substructure, and (c) a nozzle plate 13 attached to the top of the ink barrier layer 12. In accordance with the invention, a shallow (e.g., 25–100 μm) trench 15 is formed in the top portion of the substrate of the thin film substructure and has a length that extends in the direction of the length of the thin film substructure. The trench 15 is in communication with slots 17 that extend from the trench through the substructure 11 to the bottom thereof, whereby the trench 15 and the slots 17 cooperatively form a compound ink feed slot. In use, the slot openings at the bottom of the thin film substructure are in communication with an ink reservoir in the pen body that includes the printhead, and ink is channeled to ink chambers formed in the ink barrier, as described further herein.

Figure 2:
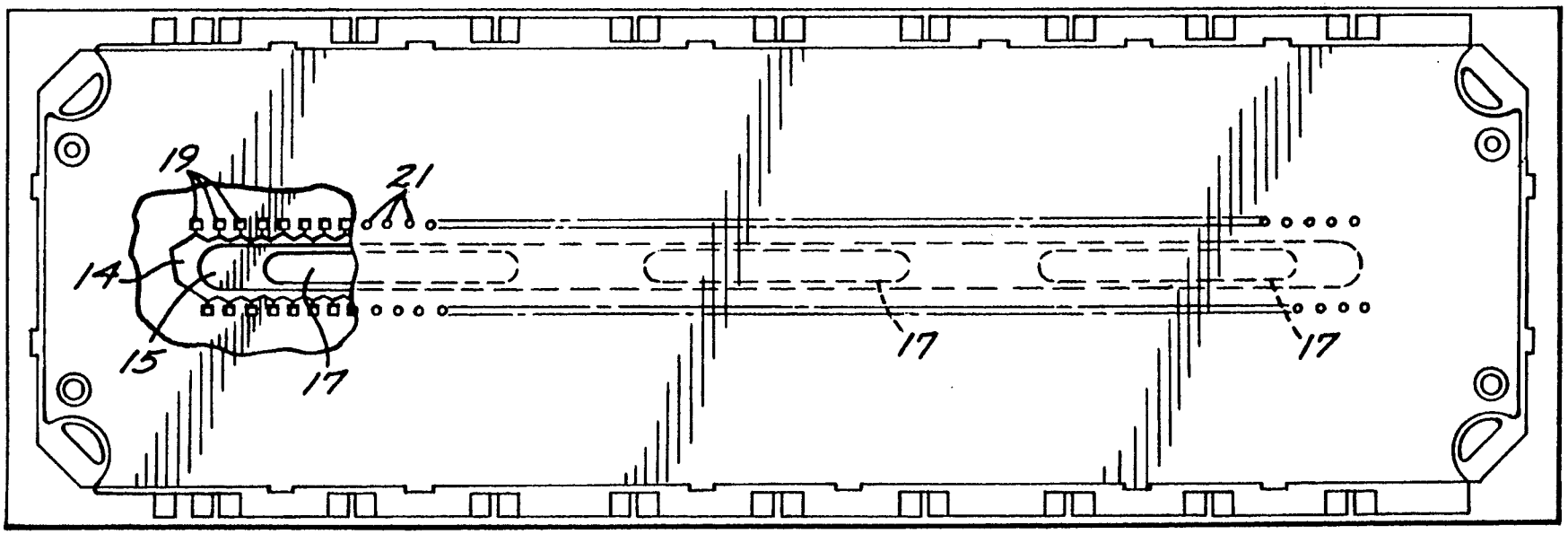
FIGS. 2 and 2A is a top plan view of the thin film thermal ink jet printhead of FIG. 1 which illustrates the location of the shallow trench and feed slots of the compound ink feed slot.
Figure 2A:
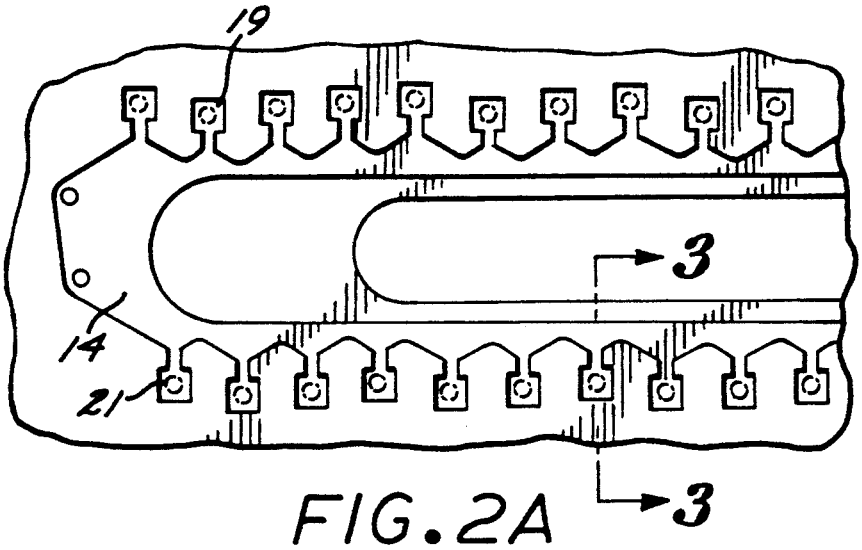
Figure 3:
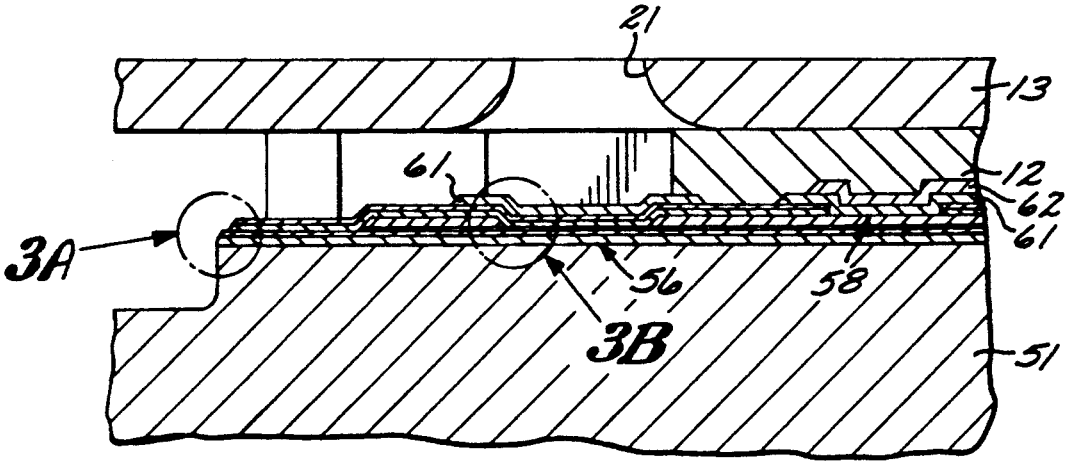
FIG. 3 is a sectional view of the thin film thermal ink jet printhead of FIG. 1 taken along the width of the shallow trench of the compound ink feed slot and which schematically depicts the different layers of the thin film thermal ink jet printhead.
Figure 3A:
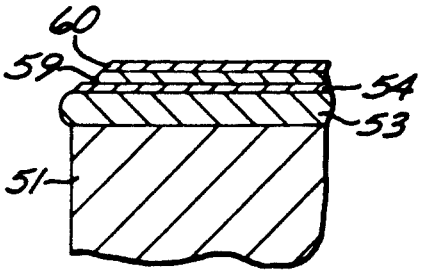
FIGS. 3A and 3B are detail sectional views of portions of the sectional view of FIG. 3.

FIG. 2 is an unscaled schematic top plan view of the thin film printhead, and sows the location of the trench 15 and the slots 17. The detail of FIG. 2A shows the ink chambers 19 formed in the ink barrier layer 12 that is disposed on top of thin film substructure and also shows in dashed circles the locations of the overlying nozzles 21 formed in the nozzle plate 13. In accordance with known printhead structures, respective ink firing resistors, as depicted in FIGS. 3 and 3A and described further below, are disposed beneath the ink chambers 19. A generally centrally located opening 14 in the ink barrier layer is in general alignment with the trench 15, and provides for the flow of ink from the trench to the ink chambers 19.

Figure 3B:
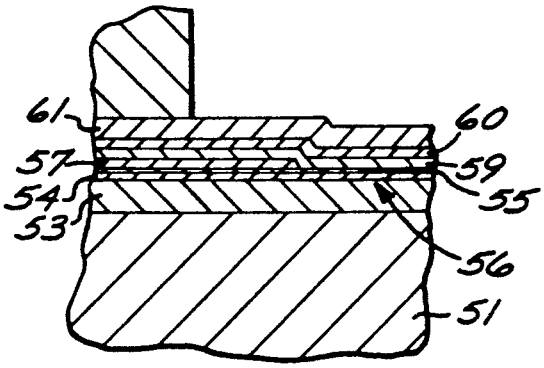

FIG. 3 sets forth an unscaled cross sectional view along the width of the trench 15, and FIGS. 3A and 3B set forth detail views of the layers of the thin film substructure 11 adjacent the trench 15 and in the regions of the ink firing resistors. The printhead includes a silicon substrate 51 in which the trench 15 is formed. A field oxide layer 53 is disposed over the silicon substrate, and a patterned phosphorous doped oxide layer 54 is disposed over the field oxide layer. A resistive layer 55 comprising tantalum aluminum is formed on the phosphorous oxide layer 54 extending over areas where thin film resistors, including ink firing resistors, are to be formed beneath the ink containing chambers. A patterned metallization layer 57 comprising aluminum doped with a small percentage of copper and/or silicon, for example, is disposed over the resistor layer 55. The resistive layer 55 and the metallization layer 57 do not extend to the edges of the trench since they are not needed in that region.

The metallization layer 57 comprises metallization traces defined by appropriate masking and etching. The masking and etch of the metallization layer 57 also defines the resistor areas. In particular, the resistive layer 55 and the metallization layer 57 are generally in registration with each other, except that portions of traces of the metallization layer 57 are removed in those areas where resistors are formed. In this manner, the conductive path at an opening in a trace in the metallization layer includes a portion of the resistive layer 55 located at the opening or gap in the conductive trace. Stated another way, a resistor area is defined by providing first and second metallic traces that terminate at different locations on the perimeter of the resistor area. The first and second traces comprise the terminal or leads of the resistor which effectively include a portion of the resistive layer that is between the terminations of the first and second traces. Pursuant to this technique of forming resistors, the resistive layer 55 and the metallization layer can be simultaneously etched to form patterned layers in registration with each other. Then, openings are etched in the metallization layer 57 to define resistors.

Ink firing resistors 56 are particularly formed in the resistive layer 55 pursuant to gaps in traces in the metallization layer 57.

A composite passivation layer comprising a layer 59 of silicon nitride ($Si_3N_4$) and a layer 60 of silicon carbide (SiC) is disposed over the metallization layer 57, the exposed portions of the resistive layer 55, and exposed portions of the oxide layer 53 at the edges of the trench, but does not extend into the trench. A tantalum passivation layer 61 is disposed on the composite passivation layer 59, 60 in areas that underlie the ink chambers 19, thus forming the bottom walls of ink containing chambers 19 that overlie the ink firing resistors 56. The tantalum passivation layer 61 provides mechanical passivation to the ink firing resistors by absorbing the cavitation pressure of the collapsing drive bubble. The tantalum passivation layer 61 can also extend to areas over which a patterned gold layer 62 is formed for external electrical connections to the metallization layer 57 by conductive vias 58 formed in the composite passivation layer 59, 60. As discussed further herein, the trench can be formed pursuant to etching of the composite passivation layer prior to the deposition and patterning of the tantalum and gold layers, or it may be desirable to remove the composite passivation layer from the trench area after all higher level thin films (tantalum and gold) have been deposited and patterned.

The foregoing printhead is readily produced pursuant to standard thin film integrated circuit processing including chemical vapor deposition, photoresist deposition, masking, developing, and etching, for example as disclosed in commonly assigned U.S. Pat. No. 4,719,477, Jan. 12, 1988, "Integrated Thermal Ink Jet Printhead And Method Of Manufacture," which is incorporated herein by reference.

More particularly, the trench area is defined as an active region to prevent the growth of field oxide over the trench area and is processed like an active region except that layers deposited or formed thereon are removed by etching. Depending on the particular process, the trench region might be doped, given that it is defined as an active area, but this is relatively unimportant. The important consideration is the removal of oxides and other materials that may slow the etching of the trench. The trench 15 itself is formed by patterning the mask for etching the silicon nitride 59 and silicon carbide 60 passivation layers to include opening such passivation layers over the trench region as well as opening the vias 58 for contacts to the tantalum and gold metallizations 61, 62. An alternative implementation would involve a second mask step for patterning the composite passivation layer after depositing and patterning the tantalum and gold metallization layers 61, 62. In either case, the tantalum and gold layers are removed from the trench region.

Figure 4A:
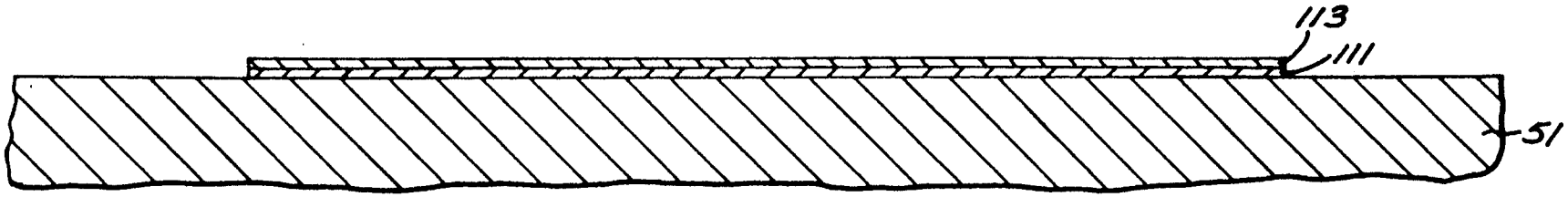
FIGS. 4A through 4H schematically illustrate a processing sequence that can be used to make the thin film thermal ink jet printhead of FIGS. 1–3.
Figure 4B:
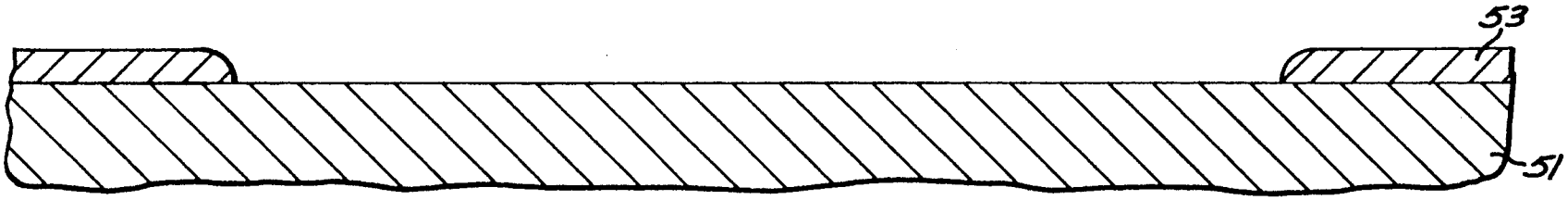
Figure 4C:
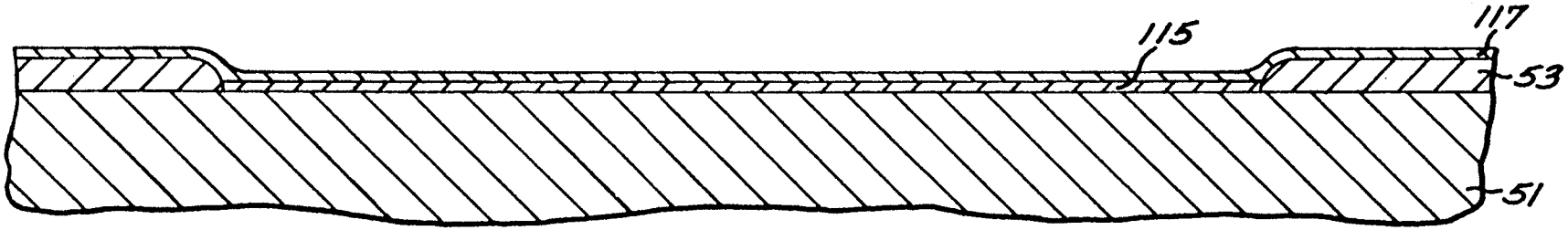
Figure 4D:
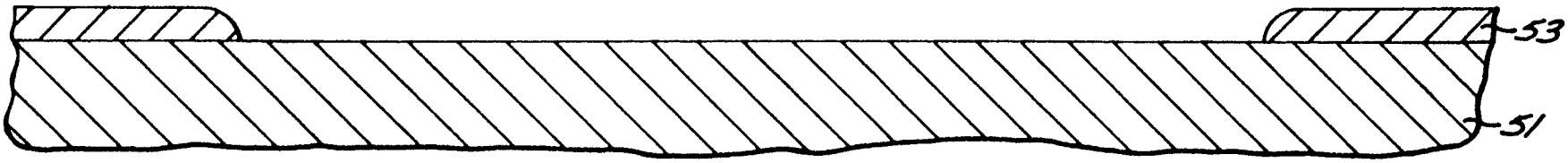

Referring now to FIGS. 4A through 4H, set forth therein are unscaled depictions along the width of the trench region of thin film substructure 11 for different stages of a processing sequence by which the thin film substructure 11 can be formed. Starting with the silicon substrate 51, the region in which the trench is to be formed is protected in same manner as any active regions where transistors are to be formed by patterned oxide and nitride layers 111, 113, as shown in FIG. 4A as to the trench region. Field oxide 53 is grown in the unprotected areas, and the oxide and nitride layers are removed, as shown in FIG. 4B. Next, gate oxide 115 is grown in the trench region and the active regions, and a polysilicon layer 117 is deposited over the entire substrate, as shown in FIG. 4C. The gate oxide and the polysilicon are etched to form polysilicon gates over the active areas, and to remove the gate oxide and polysilicon from the trench region, as shown by FIG. 4D.

Figure 4E:
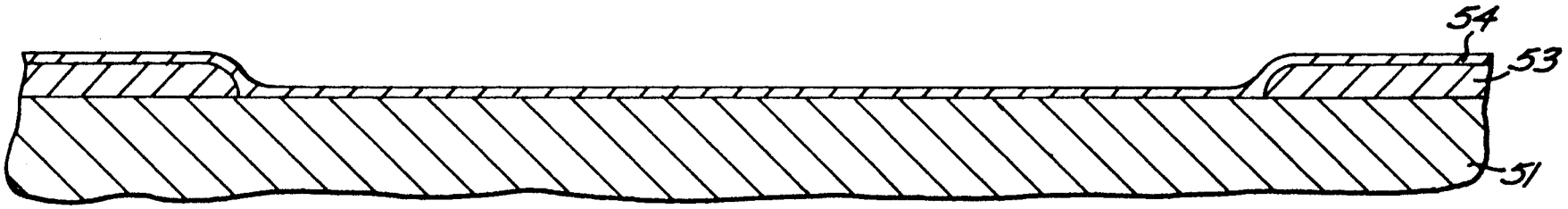
Figure 4F:
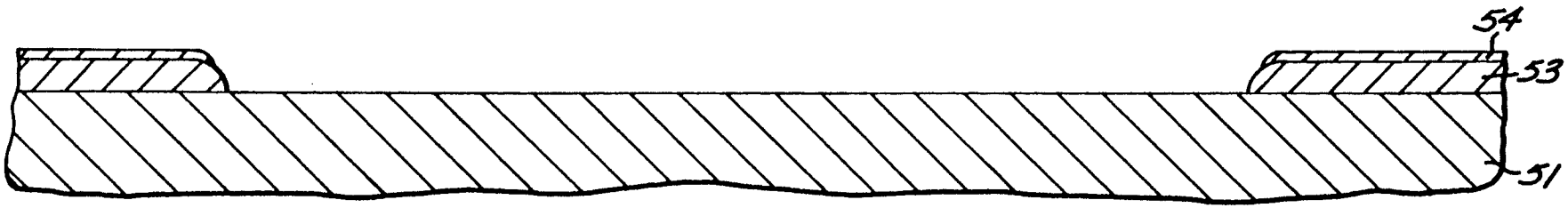

The thin film structure as represented in FIG. 4D is subjected to phosphorous predeposition by which phosphorous is introduced into the unprotected areas of the silicon substrate. A layer of phosphorous doped oxide 54 is then deposited over the entire in-process thin film structure, as shown in FIG. 4E, and the phosphorous doped oxide coated structure is subjected to a diffusion drive-in step to achieve the desired depth of diffusion in the active areas. The phosphorous doped oxide layer 54 is then masked and etched to open contacts to the active devices and to open the trench region, as shown in FIG. 4F.

The tantalum aluminum resistive layer 55 is then deposited, and the aluminum metallization layer 57 is subsequently deposited on the tantalum aluminum layer. The aluminum layer 57 and the tantalum aluminum layer 55 are etched together to form the desired conductive pattern and to remove such layers from the trench region. The resulting patterned aluminum layer is then etched to open the resistor areas.

Figure 4G:
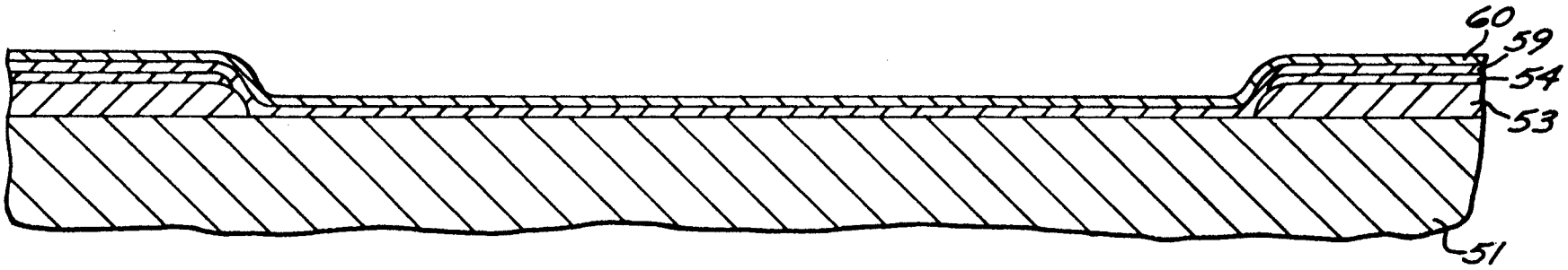
Figure 4H:
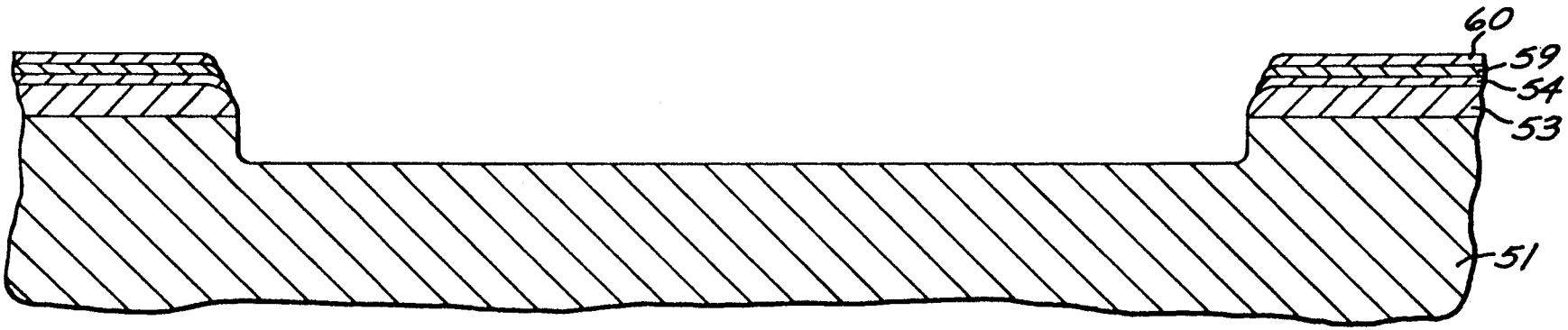

The $Si_3N_4$ passivation layer 59 and the SiC passivation layer 60 are respectively deposited, as shown in FIG. 4G. A photoresist pattern which defines the trench and vias to be formed in the $Si_3N_4$ and SiC layers is disposed on the SiC layer, and the thin film structure is subjected to overetching, which opens vias through the composite passivation layer 59, 60 to the aluminum metallization layer, and also forms the trench 15, as shown in FIG. 4H after the photoresist has been removed. In particular, the etching of the vias is limited by the aluminum, while the trench 15 is formed by over etching since the trench region of the silicon substrate is not protected by the aluminum layer.

Subsequent layers, including the tantalum passivation layer 61 and any gold layer 62 for external connections, that are deposited and etched on the structure of FIG. 4H are suitably etched from the trench 15.

It is also possible to defer the formation of the trench until after the tantalum and gold layers 61, 62 are deposited and patterned. In this implementation, the compound passivation layers 59, 60 are first patterned to create only the via openings 58 for interconnection of the aluminum metallization layer 57 with the tantalum and gold metallizations 61, 62, so that the compound passivation layer is left over the trench area. Tantalum and gold layers are then deposited and patterned simultaneously with a first masking step. A second masking step is then used to further pattern the gold layer to remove gold from the tantalum strips which serve as mechanical passivation for the firing resistors and to leave the gold in areas where it serves as an interconnect and conductor layer to the aluminum metallization layer 57. At this point an additional mask is used exclusively to form the trench by first etching through the passivation layers 59 and 60 and then by overetching into the silicon 51.

An advantage of etching the trench after depositing and patterning higher level thin film layers is the decoupling of the precision passivation via etch from the aggressive trench forming etch, which allows these process steps to be separately optimized. Also, the surface of the wafer is kept smooth for patterning the tantalum 61 and gold 62 layers by deferring the trench formation. This allows finer structures to be defined reliably in the tantalum and gold layers. In either case, the structure of the trench and other films is the same as that shown in FIG. 4H.

After the thin film substructure is formed as described above, the ink barrier layer 12 is photolithographically formed on the thin film substructure 11 using known polymer materials such as Vacrel available from the DuPont Company of Wilmington, Del., for example. The slots 17 are then formed, and the nozzle plate 13 is attached to the ink barrier 12.

The first process described above utilizes existing processing steps to make thin film printheads and does not require additional steps, with the modifications being directed to defining the trench region in the passivation masks and over etching the silicon nitride and silicon carbide passivation layers. The second process requires one additional masking step to separately etch the passivation layers and silicon to form the trench. In the second implementation the field oxide is still advantageously patterned from the trench region by defining the trench region as an active area. This field oxide patterning requires no additional steps when standard thin film integrated circuit processing as described in U.S. Pat. No. 4,719,477 is used.

In the foregoing processes, the trench 15 was formed by defining the trench region as an active region so that field oxide is not grown thereon, etching subsequently applied layers from the trench region, and overetching the SiC/SiN passivation layer to form the trench, where such overetching can take place after the formation of higher level thin film layers overlying the passivation layer.

The foregoing has been a disclosure of a thin film thermal ink jet printhead structure having increased strength, allows for smaller thin film silicon substrates, and provides for reduced manufacturing cost.

Although the foregoing has been a description and illustration of specific embodiments of the invention, various modifications and changes thereto can be made by persons skilled in the art without departing from the scope and spirit of the invention as defined by the following claims.

What is claimed is:

1. A thin film thermal ink jet printhead, comprising:

a silicon substrate having a top surface and a bottom surface; an elongated trench formed in the top surface of said silicon substrate;

a plurality of slots extending through said silicon substrate from the bottom surface thereof to said elongated trench;

a plurality of patterned thin film layers disposed on areas of the top surface of said silicon substrate apart from the trench; and an ink barrier layer disposed over said plurality of patterned layers and forming a plurality of ink containing chambers adjacent to said trench, said ink barrier layer having an opening generally in alignment with said elongated trench and in communication with said ink containing chambers;

whereby ink is conveyed from outside the printhead through said slots and trench, and into said ink containing chamber.

2. The thin film thermal ink jet printhead of claim 1 wherein said patterned layers include a resistor layer having ink drop firing resistors defined therein and a metallization layer for making electrical connections to said ink firing resistors.

3. The thin film thermal ink jet printhead of claim 2 further including passivation layers disposed over said metallization layer, and wherein said trench is formed by overetching of said passivation layers to remove said passivation layers from over the region in which the trench is to be formed.

4. A process for making a thin film thermal ink jet printhead comprising the steps of:

defining active device regions and a trench region in a top surface of a silicon substrate having a bottom surface;

forming a field oxide layer on the top surface of the substrate exclusive of the active device regions and the trench region;

forming a patterned resistive layer and a patterned metallization layer over the field oxide layer;

forming a passivation layer over all exposed layers disposed on the silicon substrate and exposed areas of the silicon substrate including the trench region;

masking and etching the passivation layer to form openings in the passivation layer to the underlying metallization layer, to remove the passivation layer from the trench region, and to form a trench in the trench region; and forming a plurality of slots extending through the bottom surface of the substrate to the trench.

* * * * *